US007294061B2

(12) United States Patent
Kwon

(10) Patent No.: US 7,294,061 B2
(45) Date of Patent: Nov. 13, 2007

(54) BILLIARD CUE

(76) Inventor: Oh Chul Kwon, 110-1605, Kangbyun Apartment, Mannyun-Dong, Seo-Gu, Daejeon 302-741 (KR)

( * ) Notice: Subject to any disclaimer, the term of this patent is extended or adjusted under 35 U.S.C. 154(b) by 49 days.

(21) Appl. No.: 10/556,110

(22) PCT Filed: Jun. 25, 2004

(86) PCT No.: PCT/KR2004/001552

§ 371 (c)(1),
(2), (4) Date: Nov. 8, 2005

(87) PCT Pub. No.: WO2005/007370

PCT Pub. Date: Jan. 27, 2005

(65) Prior Publication Data

US 2007/0078017 A1 Apr. 5, 2007

(30) Foreign Application Priority Data

Jul. 23, 2003 (KR) ..... 10-2003-0050516

(51) Int. Cl.
*A63D 15/08* (2006.01)

(52) U.S. Cl. ..... 473/44

(58) Field of Classification Search ..... 473/44–49
See application file for complete search history.

(56) References Cited

U.S. PATENT DOCUMENTS

| | | | | | |
|---|---|---|---|---|---|
| 132,054 | A * | 10/1872 | Coan et al. | ..... | 473/44 |
| 672,646 | A * | 4/1901 | Mereness | ..... | 473/44 |
| 951,453 | A * | 3/1910 | Ransom | ..... | 473/44 |
| 1,241,194 | A * | 9/1917 | Carlson et al. | ..... | 473/44 |
| 1,248,634 | A * | 12/1917 | DuBose | ..... | 473/44 |
| 1,552,442 | A * | 9/1925 | Lund | ..... | 482/20 |
| 6,869,370 | B2 * | 3/2005 | Davtyan et al. | ..... | 473/44 |
| 2004/0116196 | A1 * | 6/2004 | Nazaruk | ..... | 473/44 |

FOREIGN PATENT DOCUMENTS

| | | |
|---|---|---|
| JP | 2001070499 | 3/2001 |
| JP | 2001198256 | 7/2001 |
| JP | 2002065934 | 3/2002 |
| KR | 2019860011554 | 5/1987 |
| KR | 1019920004544 | 6/1992 |
| KR | 200164192 | 2/2000 |

* cited by examiner

*Primary Examiner*—Mark S Graham
(74) *Attorney, Agent, or Firm*—IPLA P.A.; James E. Bame

(57) ABSTRACT

A billiard cue less bendable than a standard wood cue, which is manufactured by dividing a square lumber (20), sawed from a wood material (10), into a central member (21), having a cross-shaped section in which longitudinal sides thereof are perpendicular to transverse sides lines thereof and end terminals thereof contact edges of the square lumber (20), and peripheral members (22, 23, 24, and 25) cut off from the central member, and the peripheral members (22, 23, 24, and 25) are then bonded to the central member (21) so that the direction of the annual rings of the peripheral members (22, 23, 24, and 25) is opposite to the direction of the annual rings of the central member (21), thereby offsetting stress applied to the central member (21) due to the orientation of the annual rings of the original square lumber (20), and applied to the peripheral members (22, 23, 24, and 25), and allowing maintaining its straight state without deformation.

5 Claims, 5 Drawing Sheets

【FIG. 1】
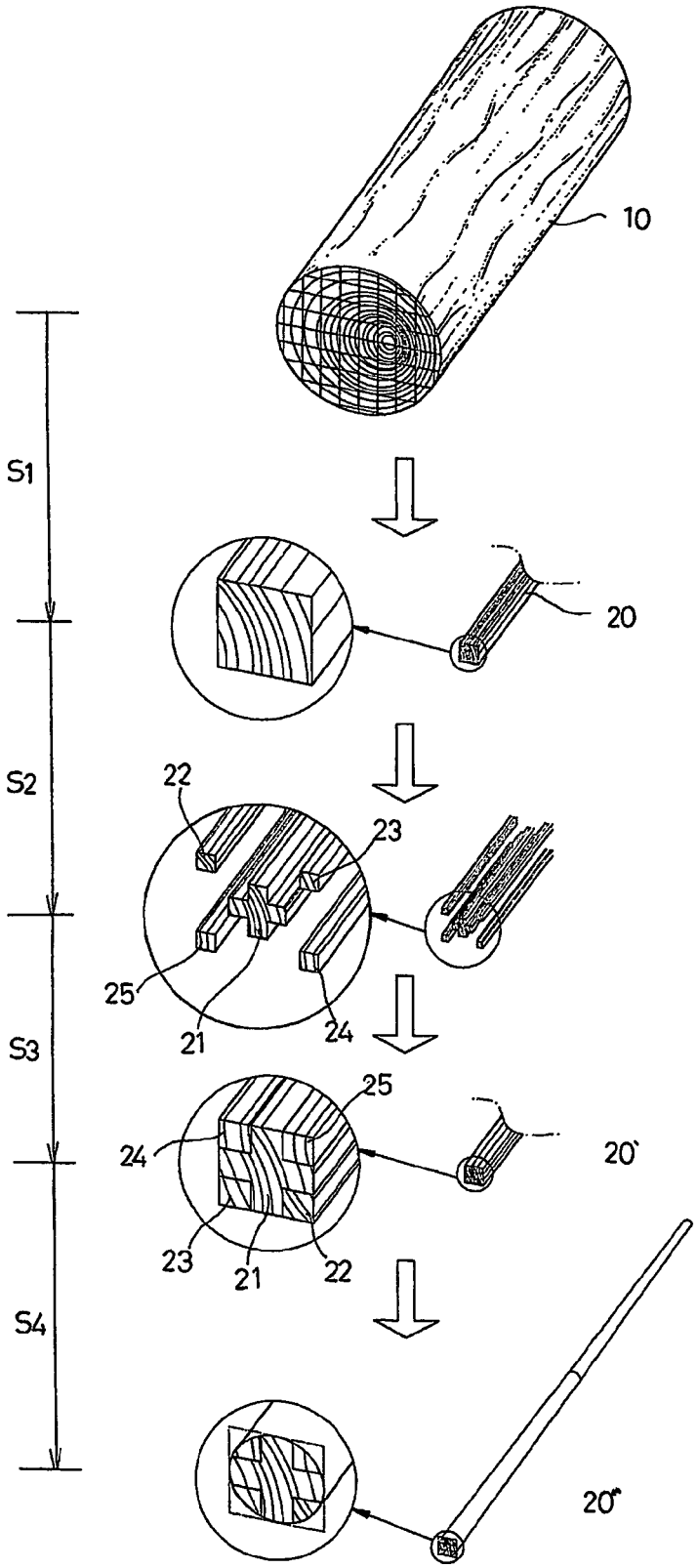

【FIG. 2】
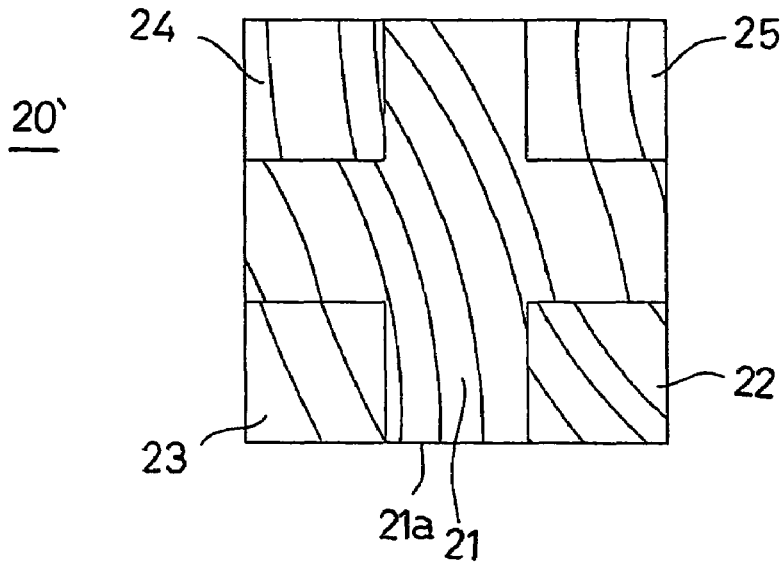

【FIG. 3】
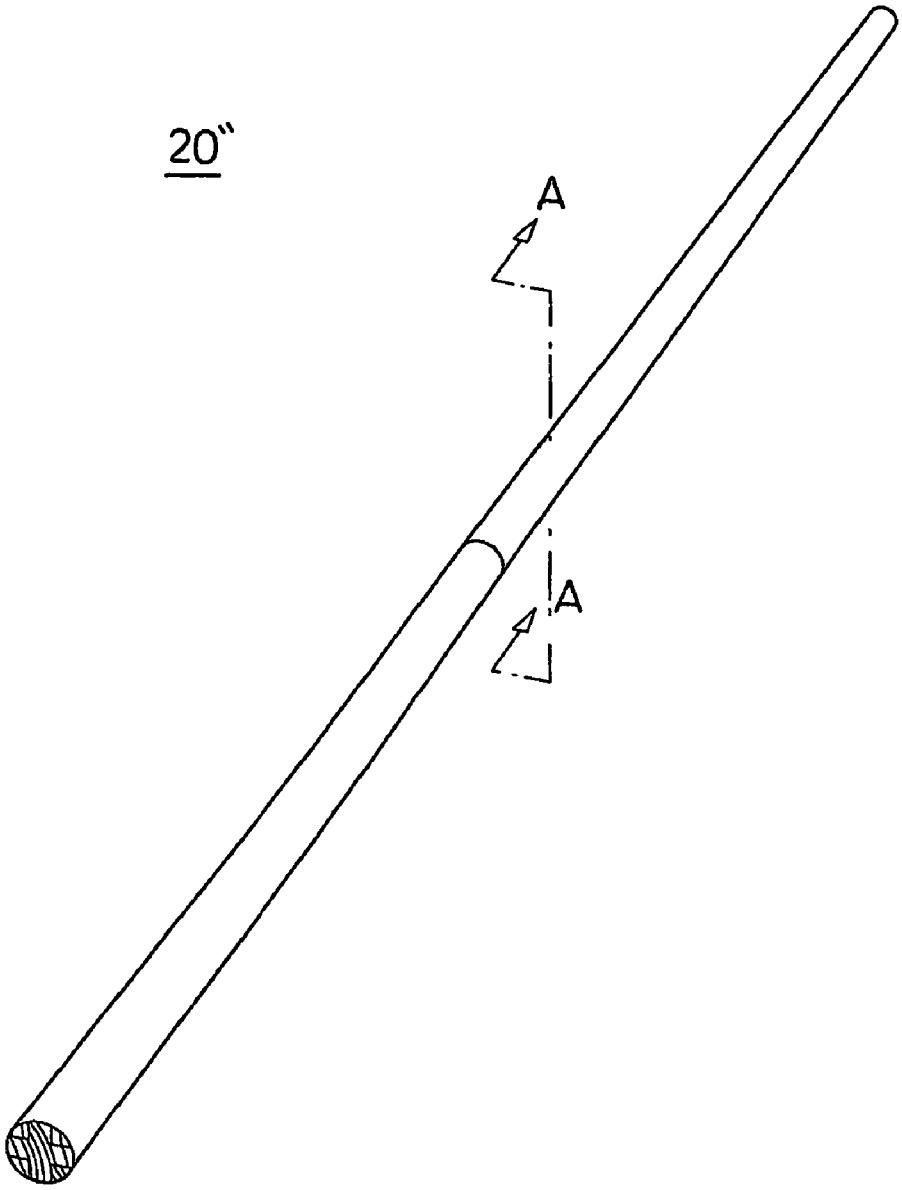

【FIG. 4】
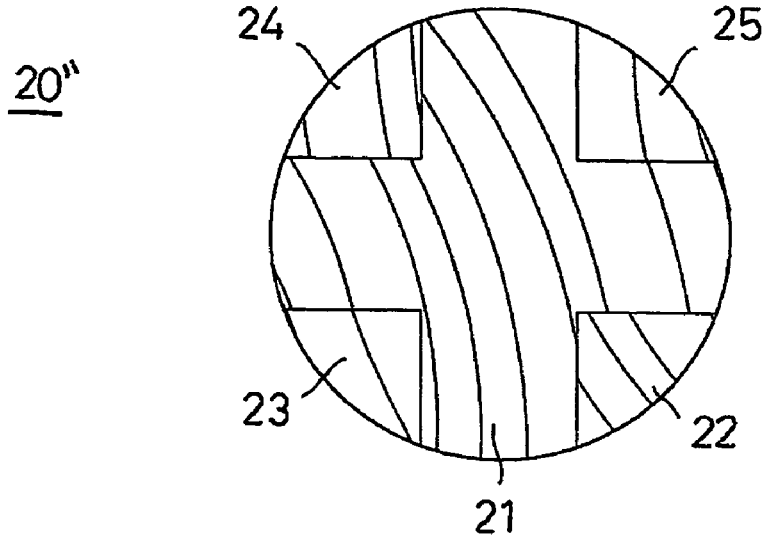
【FIG. 5】
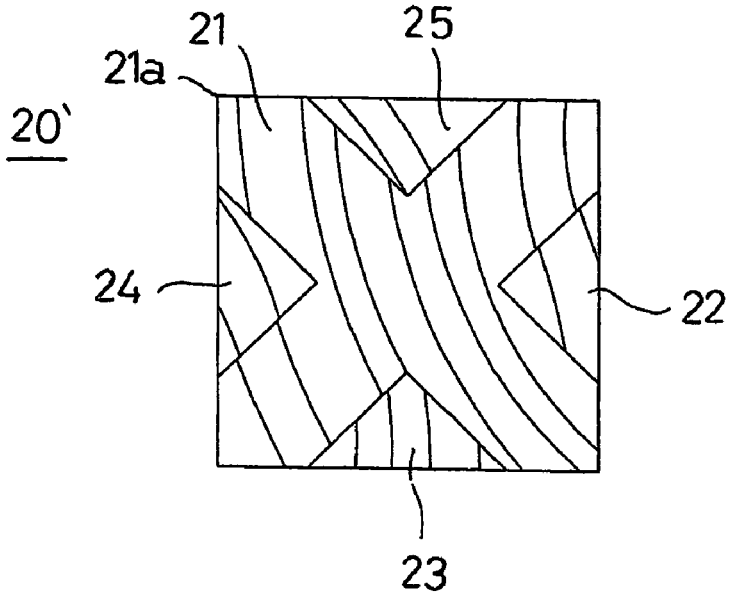

【FIG. 6】
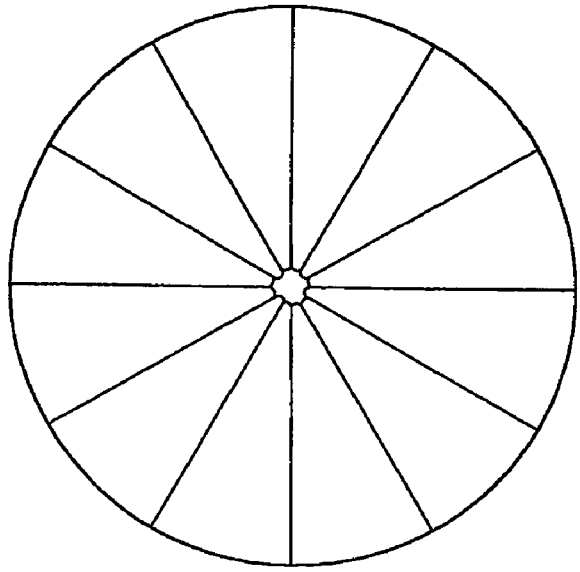

BILLIARD CUE

TECHNICAL FIELD

The present invention relates to a billiard cue less bendable than a standard wood cue, even after a long period of time has elapsed.

BACKGROUND ART

Generally, deformation of a wood material serving as furniture materials or building materials, such as distortion or warpage, is generated by contraction thereof. The constriction of the wood material differs according to species, age and trimming season of tree for the wood material and grain of the wood. The contraction percentage of the wood material is generally increased in order of a direction of fibers, a radius direction and a direction of age (annual ring or grain).

After trimming and sawing, wood material is dried for a designated period of time and is then processed to make products. The drying of the wood material protects the wood material from corrosion by bacterium and damage from insects, prevents damage, contraction and cracks thereof, improves strength and endurance thereof, and facilitates reduction in weight, coating and chemical treatment.

Mainly, conventional billiard cues have been made of hard maple. Instead of such a natural wood material, conventional billiard cues have been made of metal, such as aluminum, FRP, used as a material for fishing rods, or carbon fiber. The above materials have striking sensibility lower than that of the wood material, and generate the movement of the billiard cue in striking, thereby being incapable of absorbing impact in striking so that the impact is transmitted to a user's hand, thus being unsuitable for high-quality and popularization of the billiard cues.

For example, Korean Utility Model Registration No. 164192 discloses a billiard cue made of a wood material and a glass fiber pipe. The billiard cue comprises a shaft made of the wood material, including a handgrip portion and a strike portion, a glass fiber or carbon fiber pipe connected to the upper end of the shaft for preventing the warpage of the shaft, and a coating layer coating the pipe for protecting the pipe from external environmental stresses. Further, Korean Patent Laid-open No. 87-4717 discloses a method for manufacturing a billiard cue using a glass fiber pipe, Korean Utility Model Laid-open No. 86-11554 discloses a billiard cue manufactured by bonding and pressing rectangular pieces, cleaved from a material wood, to a conventional veneer board such that they cross each other and provided with a reinforcing plastic inserted into the central portion thereof, and Korean Utility Model Laid-open No. 84-4796 discloses a billiard cue manufactured by stacking four to eight layers of a thin plate material, which are infiltrated with carbolic acid resin at a high temperature, in a high-temperature and high-pressure state.

As time goes by, the billiard cues made of the wood material cannot maintain their straight states and are warped due to the contracting force of the wood material thereof, thereby being disadvantageous in that they cannot strike a correct point of a billiard ball and cannot provide desirable striking force or rotating force to the billiard ball.

In order to solve the warpage of the wood billiard cue, there was developed a billiard cue, which is manufactured by sawing straight lumber into a plurality of pieces having a triangular section, bonding the plural pieces in a radial shape, and machining the bonded unit using a lathe, as shown in FIG. 6. In case that the above billiard cue is used, a central portion of the billiard cue, which is not strong, depreciates striking force and striking sensibility, thereby causing general persons as well as pro billiard players to be reluctant to use the above billiard cue. Further, it is difficult to form an external or internal screw unit on the central portion (in case of an assembled cue), or to process the front end of the cue for attaching a tip thereto. Further, although the front end of the cue is processed, the processed end of the cue is easily damaged by impact.

DISCLOSURE OF THE INVENTION

Therefore, the present invention has been made in view of the above problems, and it is an object of the present invention to provide a billiard cue, which is not warped or distorted even after a long period of time has elapsed, thereby maintaining original shape and function thereof It is another object of the present invention to provide a billiard cue, which maintains its physical characteristics of an original wood material and does not require high costs and great skill during a manufacturing process, thereby not increasing a manufacturer's burden.

In accordance with the present invention, the above and other objects can be accomplished by the provision of a billiard cue manufactured by dividing a square lumber, sawed from a wood material, into a plurality of members in a longitudinal direction, relocating and bonding the plural members so that warpages of the members are offset, and machining the square lumber, obtained by bonding, using a lathe such that the obtained square lumber is gradually tapered and has a circular section, wherein the square lumber is divided into a central member, having a cross-shaped section in which longitudinal sides thereof are perpendicular to transverse sides lines thereof and end terminals thereof contact edges of the square lumber, and peripheral members cut off from the central member, and the peripheral members are then bonded to the central member so that the direction of the annual rings of the peripheral members is opposite to the direction of the annual rings of the central member.

Preferably, the square lumber may be divided into the central member and the peripheral members so that the end terminals of the central member contact sides or corners of the square lumber. Further, preferably, the peripheral members may be bonded to the central member at original positions thereof, and more preferably, at positions diagonally exchanged from original positions thereof.

Since stresses imposed to the central member and the peripheral members of the lumber for the billiard cue of the present invention, made of the same wood material, are offset to prevent warpage of the billiard cue in a longitudinal direction, while having homogeneity and maintaining characteristics of the original wood material, the billiard cue maintains its straight state without deformation even after a long period of time has elapsed. In addition to the billiard cue, the lumber may be formed into a baseball bat or various wood bars, which need to maintain a straight state.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a schematic view illustrating a process for manufacturing a billiard cue in accordance with the present invention;

FIG. 2 is a cross-sectional view of lumber in accordance with one embodiment of the present invention;

FIG. 3 is a perspective view of a billiard cue made of the lumber in accordance with one embodiment of the present invention;

FIG. 4 is an enlarged cross-sectional view taken along the line A-A of FIG. 3;

FIG. 5 is a cross-sectional view of lumber in accordance with another embodiment of the present invention; and FIG. 6 is a cross-sectional view of a conventional billiard cue provided with straight lumber.

BEST MODE FOR CARRYING OUT THE INVENTION

Now, preferred embodiments of the present invention will be described in detail with reference to the annexed drawings.

FIG. 1 is a schematic view illustrating a process for manufacturing a billiard cue less bendable than a standard wood cue. As shown in FIG. 1, the process for manufacturing the billiard cue in accordance with the present invention comprises the steps of sawing a material wood 10 into a square lumber 20 (S1); cutting the square lumber 20 in a longitudinal direction into a central member 21 having a cross-shaped section, such that longitudinal cutting lines thereof are perpendicular to transverse cutting lines thereof, and peripheral members 22, 23, 24 and 25 (S2); bonding the cut-out periphery members 22, 23, 34 and 25 to the central member 21 such that the direction of annual rings of the periphery members 22, 23. 34 and 25 is opposite to the direction of annual rings of the central member 21(S3); and post-treating the square lumber 20', obtained by bonding the periphery members 22, 23, 34 and 25 to the central member 21, through machining using a lathe. grinding and painting (S4). Through the above steps, a billiard cue 20", which is gradually tapered along the longitudinal direction, is manufactured.

In step (S1), the annual rings of the square lumber 20 sawed from the material wood 10 have shapes, which don't form contour lines of concentric circles but spread out toward one direction. Accordingly, as time goes by, the square lumber 20 and the product made of the square lumber 20 are deformed, e.g., distortion or warpage, due to the difference of contraction percentages between inner annual rings and outer annual rings.

In step (S2), the square lumber 20 is cut into the central member 21 and the peripheral members 22, 23, 24 and 25, and in step (S3), the central member 21 and the peripheral members 22, 23, 24 and 25 are bonded such that the direction of annual rings of the peripheral members 22, 23, 24 and 25 is opposite to the direction of annual rings of the central member 21, thereby preventing the deformation of the members 21, 22, 23, 24 and 25 due to the orientation of the annual rings of the original square lumber 20.

As shown in FIG. 2, the peripheral members 22, 23, 24 and 25 are cut off from the square lumber 20 so that end terminals 21*a* of the central member 21 form sides of the bonded square lumber 20'. Cutting means (not shown) for cutting off the peripheral members 22, 23, 24 and 25 from the square lumber 20 may be a cutting unit including four rotary circular cutting blades, which are separated from each other, are installed at four sides and move horizontally, and four rotary circular cutting blades, which are separated from each other, are installed at four sides and move vertically, so that the square lumber 20 passes through the four horizontally rotary circular cutting blades and the four vertically rotary circular cutting blades simultaneously or sequentially, or may be a cutting unit employing a method for cutting off the peripheral members 22, 23, 24 and 25 from the square lumber 20 one by one. After cutting, the obtained peripheral members 22, 23, 24 and 25 are marked, thereby being disposed at their correct positions in subsequent step (S3).

The four peripheral members 22, 23, 24 and 25 can be bonded to the central member 21 at positions rotated from their original positions by 180°. Preferably, as shown in FIG. 2, the four peripheral members 22, 23, 24 and 25 are attached to the central member 21 at positions diagonally exchanged from original positions thereof, that is, the peripheral members 22 and 24 exchange their positions and the peripheral members 23 and 25 exchange their positions. Here, the four peripheral members 22, 23, 24 and 25 are bonded to the central member 21 such that the direction of the annual rings of the peripheral members 22, 23, 24 and 25 is opposite to the direction of the annual rings of the central member 21, thereby offsetting stresses imposed to the peripheral members 22, 23, 24 and 25 and the central member 21 in all directions.

When the four peripheral members 22, 23, 24 and 25 are bonded to the central member 21, the direction of the annual rings of the peripheral members 22, 23, 24 and 25 is opposite to the direction of the annual rings of the central member 21, and front and rear ends of the peripheral members 22, 23, 24 and 25 are not changed.

The four peripheral members 22, 23, 24 and 25 are bonded to the central member 21 using a known bonding agent for wood. Here, pressure is applied to the four peripheral members 22, 23, 24 and 25 and the central member 21 using clamps, thereby preventing separation or poor bonding between the four peripheral members 22, 23, 24 and 25 and the central member 21.

When the four peripheral members 22, 23, 24 and 25 are bonded to the central member 21, compressed colored papers are respectively attached to interfaces between the four peripheral members 22, 23, 24 and 25 and the central member 21, thereby forming eight lines on the outer surface of the obtained billiard cue in a longitudinal direction. The above lines facilitate a users ability to determine whether or not a correct stroke is achieved, and improve the external appearance of the billiard cue. Preferably, traditional Korean papers, made of paper mulberry, are used as the above colored papers. Since the traditional Korean papers are made of a wood material, such as paper mulberry, the traditional Korean papers represent homogeneity with the billiard cue, and increase bonding strength of the bonding agent, when the four peripheral members 22, 23, 24 and 25 are bonded to the central member 21, due to fibroid materials of the traditional Korean papers having a small length.

Since the square lumber 20', obtained by bonding the four peripheral members 22, 23, 24 and 25 and the central member 21, is made of a single material, the square lumber 20' does not exhibit heterogeneity, has an excellent bonding force, and maintains physical characteristics of the original wood material 10, thereby having the same effects as the original wood material 10, i.e., the excellent striking sensibility and force and impact-absorbing ability of the wood material 10. Further, the stresses imposed to the four peripheral members 22, 23, 24 and 25 and the central member 21 are offset, thereby removing warpage of the billiard cue generated in the longitudinal direction. Accordingly, the obtained square lumber 21' is suitable for manufacturing a product, which needs to maintain its straight state for exhibiting its normal function, such as a billiard cue or a baseball bat.

FIG. 2 illustrates the square lumber 20', obtained by bonding the peripheral members 22, 23, 24 and 25 and the central member 21. Hereinafter, a difference of states between the obtained square lumber 20' and the original square lumber 20 sawed from the material wood 10 will be described. The original square lumber 20 sawed from the material wood 10, as shown in FIG. 1, has annual rings expanded in concentric circles toward the right upper part. On the other hand, the central member 21 of the obtained square lumber 20' has annual rings expanded in concentric circles toward the right upper part, but the four peripheral members 22, 23, 24 and 25 of the obtained square lumber 20' have annual rings expanded in concentric circles toward the left lower part, thereby offsetting stresses imposed to the central member 21 and the four peripheral members 22, 23, 24 and 25 and thus preventing the deformation of the square lumber 20'.

FIG. 3 is a perspective view of the obtained billiard cue 20" made of the lumber in accordance with one embodiment of the present invention, and FIG. 4 is an enlarged cross-sectional view taken along the line A-A of FIG. 3. The billiard cue 20" of the present invention is manufactured in various types, such as a separable type, in which a handgrip portion and a head portion are separable from each other, or an integral type, in which a handgrip portion and a head portion are formed in one unit. The obtained square lumber 20' is formed into the billiard cue 20" in post-treating (S4) including machining using a lathe, grinding and painting. Since a center potion of the central member 21 of the obtained square lumber 20' of the present invention maintains the physical characteristics of the original square lumber 20, the obtained square lumber 20' maintains its strength when front and rear ends and internal and external screw portions are formed, and has the same striking sensibility and impact-absorbing ability as a cylindrical lumber obtained by machining the original wood material using a lathe.

FIG. 5 is a cross-sectional view of lumber in accordance with another embodiment of the present invention. In this embodiment, the peripheral members 22, 23, 24 and 25 are cut off from the square lumber 20 so that end terminals 21*a* of the central member 21 form corners of the bonded square lumber 20', and the peripheral members 22, 23, 24 and 25 are bonded to the central member 21 such that the direction of the annual rings of the peripheral members 22, 23, 24 and 25 is opposite to the direction of the annual rings of the central member 21. That is, the central member 21 has an X-shaped section and the peripheral members 22, 23, 24 and 25 have a triangular section. The step of bonding the peripheral members 22, 23, 24 and 25 to the central member 21 of this embodiment is the same as that of the earlier embodiment.

INDUSTRIAL APPLICABILITY

As apparent from the above description, the present invention provides a billiard cue made of a wood material, in which stresses imposed to a central member and peripheral members, made of the same wood material, are offset to prevent warpage of the billiard cue in a longitudinal direction, while having homogeneity and maintaining characteristics of the original wood material, thereby maintaining its straight state without deformation even after a long period of time has elapsed. In addition to the billiard cue, the lumber may be formed into a baseball bat or various wood bars, which need to maintain their straight states.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A billiard cue less bendable than a standard wood cue and manufactured by dividing a square lumber, sawed from a wood material, into a plurality of members in a longitudinal direction, relocating and bonding the plural members so that warpages of the members are offset, and machining the square lumber, obtained by bonding, using a lathe such that the obtained square lumber is gradually tapered and has a circular section, wherein the square lumber is divided into a central member, having a cross-shaped section in which longitudinal sides thereof are perpendicular to transverse sides lines thereof and end terminals thereof contact edges of the square lumber, and peripheral members cut off from the central member, and the peripheral members are then bonded to the central member so that the direction of the annual rings of the peripheral members is opposite to the direction of the annual rings of the central member.

2. The billiard cue as set forth in claim 1, wherein the square lumber is divided into the central member and the peripheral members so that the end terminals of the central member contact sides of the square lumber, and the peripheral members are then bonded to the central member at positions diagonally exchanged from original positions thereof.

3. The billiard cue as set forth in claim 1, wherein the square lumber is divided into the central member and the peripheral members so that the end terminals of the central member contact corners of the square lumber, and the peripheral members are then bonded to the central member at positions diagonally exchanged from original positions thereof.

4. The billiard cue as set forth in any one of claims 1 to 3, wherein colored papers are respectively attached to interfaces between the central member and the peripheral members.

5. The billiard cue as set forth in claim 4, wherein the colored papers are traditional Korean papers made of paper mulberry.

* * * * *